United States Patent [19]

Miletich

[11] Patent Number: 4,626,975

[45] Date of Patent: Dec. 2, 1986

[54] FLOOD LIGHT FIXTURE CONSTRUCTION

[75] Inventor: Don Miletich, Greenfield, Wis.

[73] Assignee: Cooper Industries, Inc., Houston, Tex.

[21] Appl. No.: 715,426

[22] Filed: Mar. 25, 1985

[51] Int. Cl.[4] ..... F21S 1/02

[52] U.S. Cl. ..... 362/418; 362/431; 362/427

[58] Field of Search ..... 362/375, 223, 269, 287, 362/307, 310, 362, 372, 407, 418, 311, 427, 431

[56] References Cited

U.S. PATENT DOCUMENTS

| | | | |
|---|---|---|---|
| 3,213,273 | 10/1965 | Zagel | 362/431 |
| 4,143,413 | 3/1979 | Kelly | 362/418 |
| 4,164,784 | 8/1979 | Jaksich | 362/427 |
| 4,379,321 | 4/1983 | Plemmons | 362/310 |

*Primary Examiner*—James C. Yeung

*Attorney, Agent, or Firm*—Eddie E. Scott; Alan R. Thiele

[57] ABSTRACT

A flood light fixture for pivotable mounting to a pole or tenon is disclosed. The fixture includes a hollow mounting arm pivotably mounted to the fixture having a relieved portion defining a mounting wall. A transverse mounting bracket is slideably retained in a pair of grooves internally of the fixture housing and receives a thread fastener extending through a mounting boss on the mounting arm. A photoelectric sensor is mounted with the hollow mounting arm. Novel hinge assemblies comprising an arcuate shaped clip fastened to a flange on the housing encircles a pin on the housing cover providing for retention and pivotable movement of the cover, and a pair of wire formed latches are attached to the housing and clamp the cover to the housing.

22 Claims, 14 Drawing Figures

FLOOD LIGHT FIXTURE CONSTRUCTION

BACKGROUND OF THE INVENTION

This invention in general relates to lighting fixtures. More particularly the invention relates to an outdoor floodlight fixture of the type for mounting on a pole or tenon or other structure and which is adapted to be selectively positioned to illuminate desired areas. In still greater particularity the invention relates to a fixture having a mounting member that employs fewer parts and provides for mounting of a photoelectric cell within the fixture mounting arm.

Outdoor floodlight fixures typically include a housing within which appropriate electrical components and a reflector are mounted for generating and directing light at a desired area to be illuminated. These fixtures must provide both access to the internally mounted electrical components as well as means for adjusting the vertical angle of the fixture so as to provide for changing the area to be illuminated. Whether mounted to a wall or, as is most often the case, to a pole or tenon, the mounting of these fixtures has typically been accomplished with a rotatable or pivotable joint employing a knuckle or trunnion structure. Perhaps the most common mounting structure is that which utilizes a pin through each of a pair of knuckle halves respectively affixed to an external surface of the fixture and to an external mounting member. Another pivotably adjustable joint is disclosed in U.S. Pat. No. 4,143,413 wherein one-half of the joint is incorporated in a first member which is mounted to an external surface of a fixture housing and a second half of the joint is mounted to the external mounting member. This particular joint employs a circular projection on one half of the joint and a complementary circular seat on the adjoining member which cooperate to effect relative rotation. A threaded fastener is used to frictionally retain the two halves together at selected positions. These mounting arrangements all have a common shortcoming in that they require two separate, relatively large mounting pieces; one affixed to an external surface of the fixture and a second mounted to the external mounting member. This two piece construction is generally esthetically not pleasing, but more importantly, is not cost effective to manufacture in that two relatively large machined pieces are required. It would therefore be desirable to provide a floodlight fixture having a simplified, cost effective to manufacture and esthetically pleasing structure.

SUMMARY OF THE INVENTION

Accordingly, the present invention overcomes the shortcomings of the prior art by providing a floodlight fixture construction having a substantial portion of a rotational mounting arrangement cast integrally into the housing of the fixture.

According to an important aspect of the invention, the housing of the light fixture includes a cast in releived portion defining an upstanding mounting wall which is provided with a circular clearance opening into the interior of the housing and into which a complementary boss on a mounting arm is rotationally journaled and retained.

According to another important aspect of the invention, the mounting arm is releasably locked at selected angular positions relative to the housing with a threaded fastener that passes through a hole in the mounting boss and engages a retention plate within the housing interior behind the mounting wall.

Another feature of the invention includes a slotted, upstanding member cast integrally into the housing interior and a spring clip for removably retaining the retention plate within the slotted upstanding member.

A further important feature of the invention provides for a hollow mounting arm including means for mounting to an external mounting member and which includes a clearance opening providing for passage of electrical leads to the electrical components mounted within the fixture housing and to an external power supply.

A still further important aspect of the invention provides for a photoelectric cell mounted within the hollow mounting arm.

Another feature of the invention provides for a removable cover assembly attached to the housing with a novel hinge assembly which includes a stamped curvilinear shaped clip that engages a pin on the cover and is affixed to a flange on the housing with a threaded fastener.

A light fixture constructed according to the principles of the present invention is esthetically pleasing and is cost efficient to manufacture in that at least one major component of the heretofore typical mounting arrangement is eliminated by employing the novel mounting arm structure.

BRIEF DESCRIPTION OF THE DRAWINGS

The invention will become better understood after a reading of the following detailed description taken in conjunction with the accompanying drawings wherein:

FIG. 12 is a perspective view of one portion of a preferred embodiment of a cover latch showing details of construction;

FIG. 13 is a perspective view of a second portion of a preferred embodiment of a cover latch showing details of construction;

FIG. 14 is a cross sectional view through one latch assembly showing details of construction.

DETAILED DESCRIPTION OF THE PREFERRED EMBODIMENT

Figure 2:
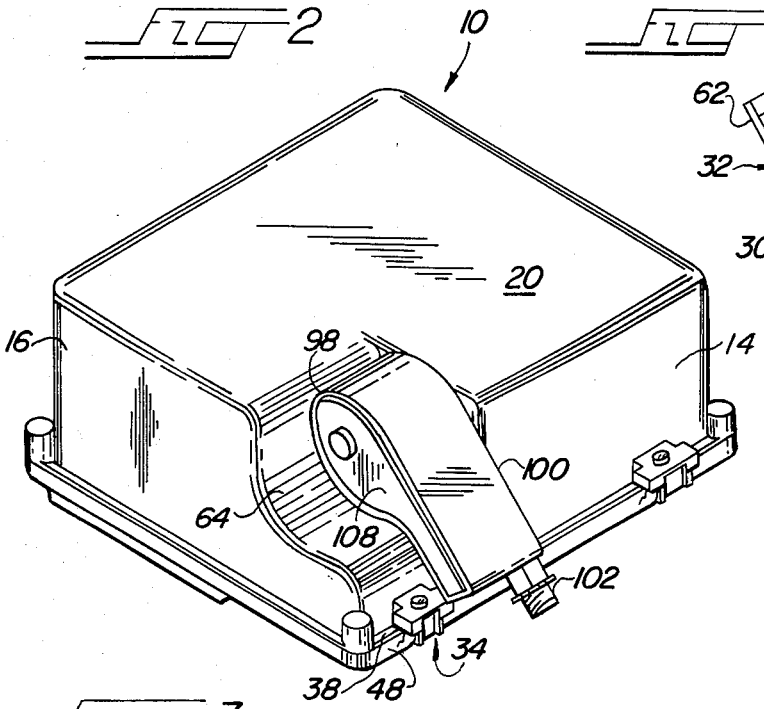
FIG. 2 is a perspective view of a floodlight fixture embodying the principles of the present invention taken generally from the rear showing location of the mounting arm arrangement.
Figure 1:
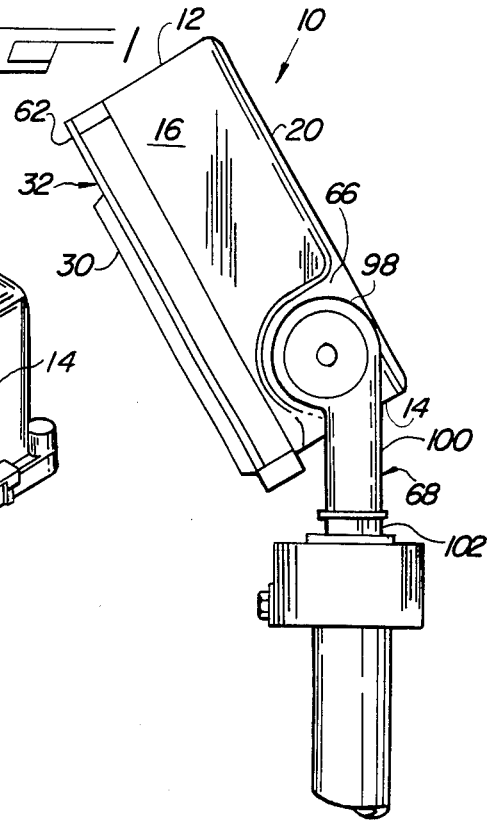
FIG. 1 is a side elevational view of a floodlight fixture embodying the principles of the present invention shown mounted on a pole.

Referring to FIGS. 1 and 2, there is shown an outdoor lighting fixture 10 including a generally rectilinear housing preferably being a one piece die cast part including a top wall 12, a bottom wall 14 and opposing side walls 16, 18. The respective side walls, top and bottom are joined together at their ends and a back wall 20 closes the back of the housing forming an interior compartment. Mounted within the interior of the housing are appropriate electrical components designated generally as 22 in FIG. 11, for electrically energizing an electric socket, 24 within which an electric lamp, 26 is engaged. A reflector 28 is mounted within the housing behind the lamp adjacent a transparent portion 30 in a cover 32 that is mounted in the front opening of the housing. The reflector is configured in well known manner to reflect the light generated by the lamp through the transparent portion of the cover.

Figure 11:
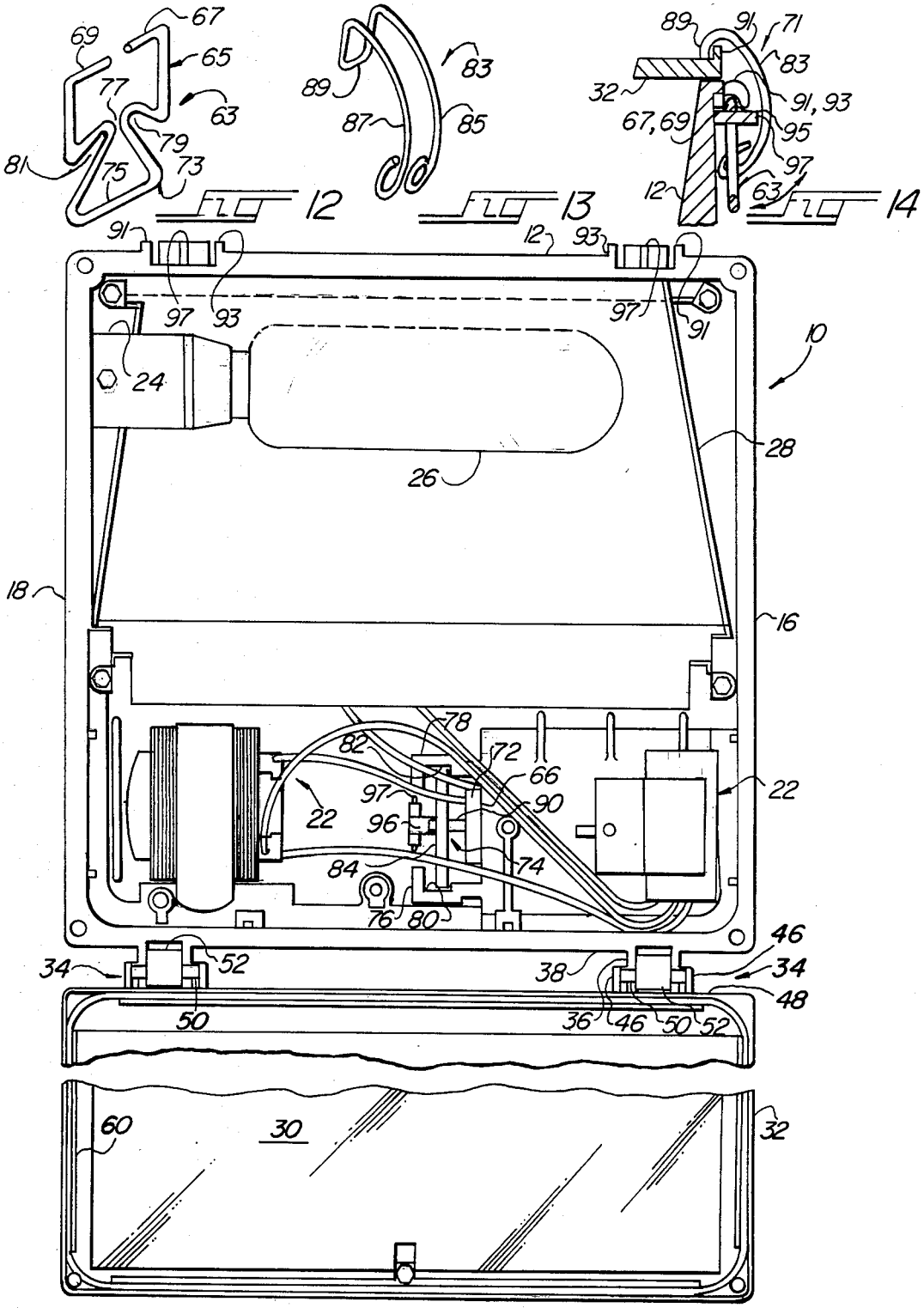
FIG. 11 is a partial front elevational view of the floodlight cover open showing arrangement of electrical components and details of construction of the mounting arm attachment structure.

As shown in FIG. 11, the cover is pivotally attached to the housing by a pair of hinge assemblies 34. According to an important aspect of the invention, each hinge assembly as shown in FIGS. 6–9, includes a flange 36 which protrudes generally outwardly from one edge 38 of the housing adjacent the open front. The flange in turn is provided with a pair of spaced apart ears 40 that protrude outwardly and perpendicular to the flange 36. Flange 36 includes a clearance hole 42 located intermediate the pair of tabs which receive a threaded fastener 54 as set out hereinbelow. The distal end of each ear 40 includes a generally semicircular cut out portion 44 which receives a hinge pin 50 also as set out hereinbelow. The cut outs 44 need not be semicircular, but can be, for example, rectangular or V-shaped.

Figure 8:
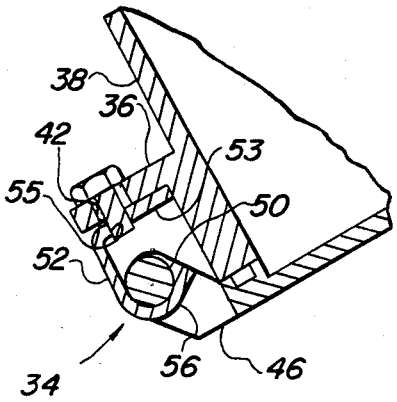
FIG. 8 is a vertical cross sectional view taken along the line 8—8 of FIG. 7 showing details of construction of the hinge assembly.

Still referring to FIGS. 6–9, the cover 32 is provided with a pair of spaced apart tabs 46 on an edge 48 immediately adjacent the ears 40 on the housing when the cover is in place. The tabs 46 depend from the cover edge 48 and are spaced so as to be positioned outboard of the ears 40 on the housing flange 36. The hinge pin 50 spans the space between the tabs 46 and is oriented parallel to the cover edge 48. The tabs 46, ears 40, cutouts 44 and hinge pin 50 are dimensioned such that the pin 50 is received in the cut-out portion 44 when the cover is placed in the opening of the housing so as to support the cover and provide for rotation of the pin within the cut outs. A retention clip 52 is positioned between the ears 40 against the flange 36 and retains the hinge pin in the cut-out portions. As best shown in FIG. 8, the retention clip 52 is preferably a stamped metallic piece including a first, generally planar, portion 53 which is provided with a threaded hole 55 aligned with the clearance hole 42 in the flange 36. As shown in FIG. 8, the clip 52 is secured to the flange with the threaded fastener 54. Again referrring to FIG. 8, the clip 52 includes a second, intermediate, portion 57 which extends from the planar portion at substantially a right angle thereto and a third portion 56 extending from the intermediate portion and which is configured to at least partially encircle the hinge pin and enter the space between the hinge pin and the cover edge. It can be seen that the retention clip 52 is, as stated, preferrably a one-piece stamped or folded curvilinear member wherein one end is partially folded back over itself to form a hook shaped configuration to partially encircle the hinge pin. A hinge constructed according to the invention is a strong, reliable and easily operated hinge providing support and rotation of the cover. Other hinges employing the principles of the present invention can be readily devised by those skilled in the art and are to be considered to be within the scope of the present invention.

Now, referring to FIGS. 1 and 11, the cover is also provided with a gasket 60, for example an O-ring, for sealing the interior of the housing from the environment and is held in the closed position by a pair of screws 62 at each uppermost corner. The screws 62 can be replaced with other retention means including, for example, a quick release type latch or clamp such as an overcenter latch as shown in FIG. 12, 13 and 14.

Referring to FIGS. 12, 13 and 14, the latch includes a wire formed clamp comprising two members. A first member 63 is formed from a continuous piece of wire, preferrably being stainless steel or spring tempered wire, configured into two portions. A first housing engageable portion 65 is generally rectangular and includes a pair of opposing, aligned, pin-like end portions 67, 69 having their ends spaced apart and are configured to be pivotably received in a latch engagement structure 71 on the housing. A second portion 73 is configured in a triangular shape defining a free end 75 suitable for engagement by an operator's fingers. The opposite sides of the triangular shaped finger engageable second portion are folded back over themselves where the apex 77 of the triangular portion meets the rectangular first portion. The folded side portions define a pair of loops 79, 81 which are configured to engage one end of a second wire formed member 83. The second member 83 is also formed from a single length of stainless steel spring tempered wire and is configured to form a pair of parallel arcuate shaped body portions 85, 87 each having one end folded back over themselves to engage the loops 79, 81 of the first latch member and have their opposite ends folded back over themselves to form a hook 89 which engages a lip or raised portion 91 provided on the cover as shown in FIG. 14.

Referring to FIG. 14, the housing is provided with a pair of spaced apart protuberances 91, 93 extending from the top edge of the housing at the frontal opening. Each protuberance is provided with a generally semicircular relief 95 through which the respective pin portions 67, 69 extend. A flange 97 extends from the housing and is positioned slightly out of alignment with the reliefs, whereby the pins rest on the flange and are received against the protuberances within the reliefs. It can be seen that the latch retention structure provides for pivotable movement of the latch assembly and that the cover is clamped to the housing by engaging the hook to the cover lip and pivoting the handle so that the attachment of the second latch member to the first latch member pivots to an over center locked position.

Figure 4:
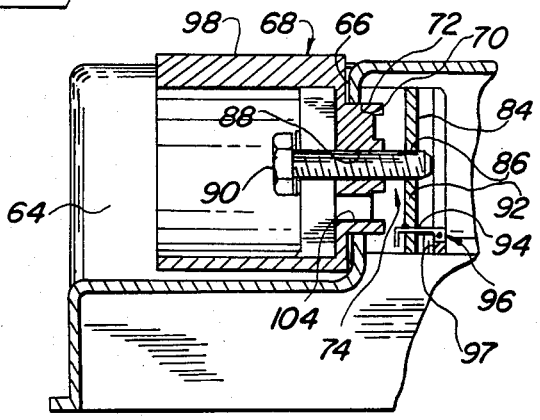
FIG. 4 is a cutaway cross sectional view taken along the line 4—4 of FIG. 3 showing details of construction of the mounting arm attachment.
Figure 5:
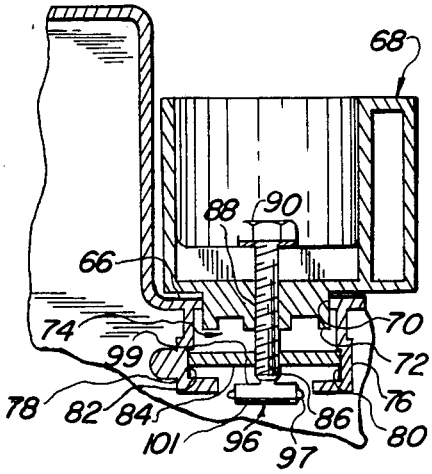
FIG. 5 is a cutaway cross sectional view taken along the line 5—5 of FIG. 3 showing further details of construction of the mounting arm attachment.

The housing has a relieved portion 64 cast integrally thereinto preferably at one lowermost corner of the housing whereat the bottom 14, back 20 and one side 16 meet which creates a mounting wall 66 that extends into the interior of the housing perpendicularly from the bottom wall at a location intermediate the opposing side walls 16, 18. The relieved portion 64 is radiused defining a generally semi-cylindrical relief which allows a mounting arm 68 to rotate within the releived portion as set out hereinbelow. As shown in FIGS. 4 and 5, the mounting wall 66 includes a circular clearance opening 70 into which a complementarily sized circular boss 72 on the mounting arm is rotatably journaled. With the boss 72 received in the clearance opening 70, the mounting arm and housing are free to be rotated or pivoted relative to each other which provides for vertical angular positioning of the housing and aiming of the light as desired as shown in FIG. 1.

In order to releasably lock the housing at selected angular positions, a lock mechanism 74 is provided as shown in FIGS. 4 and 5. Cast integrally into the housing back and extending into the interior adjacent the mounting wall 66 are a pair of upstanding members 76, 78. The upstanding members 76, 78 are located at diametrically opposing positions relative to the clearance opening 70 and include a pair of opposing aligned slots 80, 82 lying in a plane orientated parallel to the mounting wall 66 and into which a plate 84 is slideably received.

The plate 84 has a threaded hole 86 that is coaxially aligned with a clearance aperture 88 located centrally through the boss 72 on the mounting arm. A threaded fastener 90 in the form of a bolt is positioned in the clearance aperture 88 of the boss and is threadedly engaged within the hole 86 in the plate 84. It can be seen that the boss 72 is rotatable in the clearance opening 70 when the bolt is loosened and thereby provides for positioning of the housing relative to the mounting arm. The housing and mounting arm are locked in the desired position by tightening the bolt 90.

Should the fastener 90 be completely disengaged from the hole 86, such as whenever the housing is to be completely removed from the mounting arm for servicing of the fixture, the plate 84 would be free to inadvertently fall out of the slots 80, 82. Therefore, the plate 84 is provided with a second hole 92 below the threaded hole 86 and receives therein a projecting portion 94 of a spring type clip 96. As shown in FIG. 4 and 5, the housing includes a tab 97 cast into the back wall and which is frictionally engaged on opposite sides by a pair of complementary legs 99, 101 on the clip 96. It can be seen that the plate is thereby retained in the slot and the bolt 86 can be removed without inadvertent loss of the plate 84. Other mounting arm retention arrangements employing the principles of the invention can be devised. For example, the pair of upstanding members 76, 78 can be replaced with a single, solid, non-slotted, upstanding, wall-like member cast into the housing adjacent the opening 70 in the wall 66 and provided with the threaded hole 86. Such an arrangement would eliminate the need for the plate 84 and the clip 96.

As shown best in FIGS. 1, 2, 3 and 10, the mounting arm 68 is a one piece, cast, hollow housing having a substantially cylindrical portion 98 coaxial with the boss 72 which is sized to be received in the semi-cylindrical relief in the housing providing for the necessary rotation as well as being substantially recessed and generally out of sight contributing to an esthetically pleasing appearance. The mounting arm also includes a rectilinear portion 100 extending tangentially from the cylindrical portion 98 and includes a mounting adaptor 102 at its free end. In the embodiment shown, the mounting adaptor is a standard threaded electrical coupler suitable for mounting to an electrical junction box or other device having complementary thread for a water tight connection.

Figure 3:
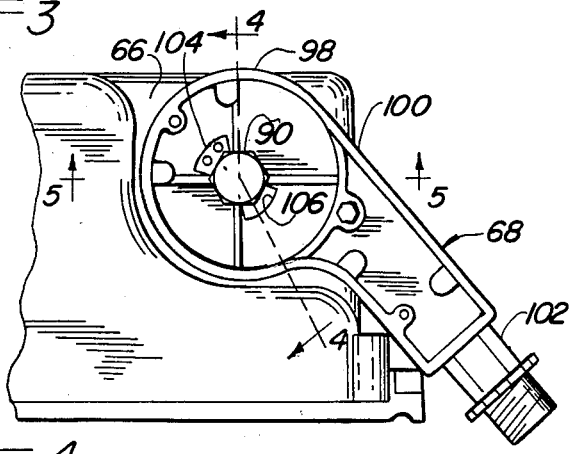
FIG. 3 is a partial side elevational view of the floodlight fixture showing details of the mounting arm.
Figure 10:
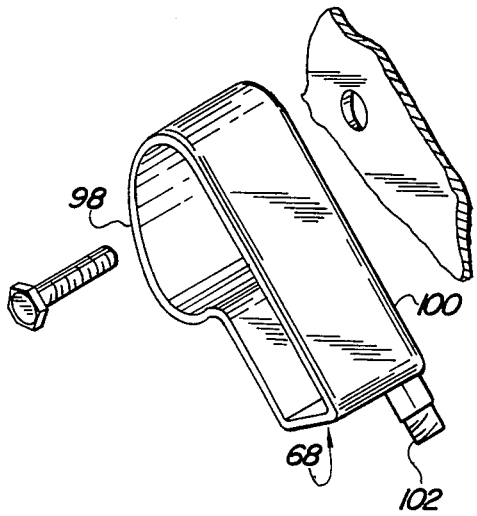
FIG. 10 is an exploded perspective view of the mounting arm components.
Figure 10:
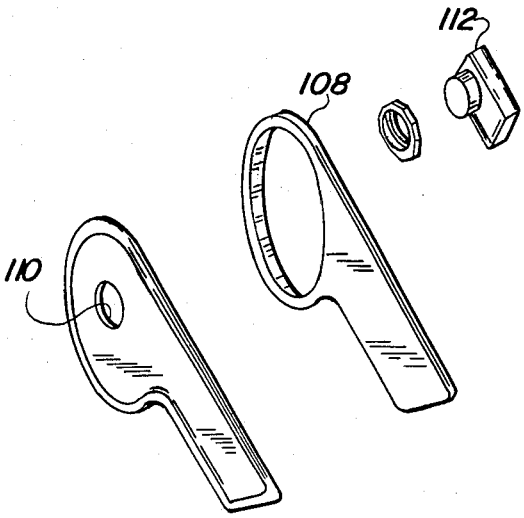
Figure 6:
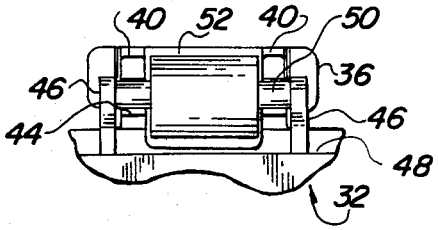
FIG. 6 is front elevational view of one hinge assembly.
Figure 9:
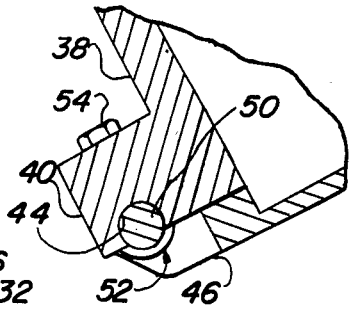
FIG. 9 is a vertical cross sectional view taken along the line 9—9 of FIG. 7 showing details of the hinge assembly.
Figure 7:
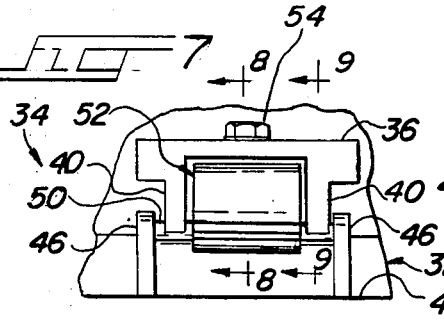
FIG. 7 is a bottom elevational view of one hinge assembly.

The mounting arm is also provided with a second opening through the boss 72 in the form of a pair of arcuate slots 104, 106 extending partially around the clearance opening 70. The slots 104, 106 provide access for the electrical leads to the electrical components within the housing interior. As shown in FIGS. 3 and 10, the mounting arm housing is open on the side opposite the boss and is covered by a gasketed removable cover plate 108. The cover plate includes a hole 110 which receives the sensor portion of a photoelectric cell/switch assembly 112 mounted within the interior of the mounting arm. The photo-electric sensor switch assembly is electrically coupled to the electrical components in a well known manner and includes electrical leads for connection to an external power source.

Having described the preferred embodiment of the invention, those skilled in the art having the benefit of said description in conjunction with the accompanying drawings can readily devise other embodiments and modifications. Therefore, said other modifications and embodiments are to be considered to be within the scope of the appended claims.

I claim:

1. A lighting fixture comprising:

a generally rectilinear housing having an open front end in a relieved portion in a clearance opening in a side wall;

electrical component means including a lamp socket mounted within said housing for energizing an electric lamp;

light reflector means mounted within said housing for reflecting light from said lamp from the front of said housing;

a mounting arm operatively associated with said relieved portion, said mounting arm including means for attachment to an external mounting member and having means for mounting said mounting arm to said housing, said means for mounting said mounting arm to said housing received in said clearance opening and providing for relative pivotal movement between said housing and said mounting arm; and means for releasably locking said housing at selected angular positions relative to said mounting arm, said locking means being associated with said means for mounting said arm to said housing.

2. The light fixture as defined in claim 1, wherein said means for mounting said mounting arm to said housing comprises:

a boss on said mounting arm rotatably journaled in said clearance opening in said side wall of said housing.

3. The light fixture as defined in claim 2, wherein said boss is circular and said clearance opening is a complimentarily sized hole.

4. The light fixture as defined in claim 3, wherein said means for releasably locking comprises:

said mounting arm having a clearance hole extending coaxially through said circular boss;

a threaded fastener extending through said clearance hole in said mounting arm; and fastener engagement means within said housing, said threaded fastener threadably engaged to said fastener engagement means.

5. The light fixture as defined in claim 4, wherein said fastener engagement means comprises:

at least one upstanding member cast into said housing adjacent said clearance opening in said housing, said upstanding member including a threaded hole coaxially aligned with said clearance hole in said arm, said threaded fastener engaged in said threaded hole.

6. The light fixture as defined in claim 4, wherein said fastener engagement means comprises:

a slotted member case integrally into said housing interiorly thereof adjacent said side wall of said housing, said slot opening lying in a plane perpendicular to the principal longitudinal axis of said clearance hole; and a plate slidably received in said slot, said plate including a threaded aperture coaxially aligned with said clearance hole in said boss, said threaded fastener engaged in said threaded aperture.

7. The light fixture as defined in claim 6, further comprising clip means for retaining said plate in said slot.

8. The light fixture as defined in claim 7, wherein said clip means comprises:

said plate having a second aperture;

a tab cast integrally into said housing adjacent said second aperture;

a spring clip having one portion removably engaged to said tab and including a projecting portion received in said second aperture in said plate.

9. The light fixture as defined in claim 1 further comprising:

latch means for releasably clamping a transparent pivotable cover to said housing over said open front, said latch means including at least one latch having at first wire formed member defining a pair of aligned opposing pin-like end portions pivotably received in wire latch retention means cast integrally into said housing adjacent an edge thereof at said open front, said first wire formed member configured to define a finger engageable handle portion opposite said pin-like end portions providing for pivoting of said first member about said pin-like end portions and further being formed to define means intermediate said handle portion and said pin-like end portions for engaging thereto a second wire formed member including an arcuate shaped elongated portion having one end thereof formed to pivotably engage said means for engaging said second member and having a portion at a free end thereof formed back over itself defining a hook configured to engage a raised portion on said cover.

10. The light fixture as defined in claim 9 wherein said wire formed latch means defines an overcenter clamp.

11. The light fixture as defined in claim 9, wherein said wire latch retention means includes a pair of spaced apart protuberances extending outwardly from said housing, said protuberances including a pair of aligned arcuate shaped openings therethrough, a flange protruding outwardly from said housing disposed from said aligned openings, said pin-like end portions of said first member each extending through a respective one of said pair of aligned openings and being received against said flange, whereby each said pin-like portion is pivotably retained between said protuberances and said flange.

12. A light fixture comprising:

a generally rectilinear housing having a top, a bottom and two opposing sides joined together in end-to-end relationship, said housing having a closed back and an open front and a relieved portion at a corner defined by the junction of said bottom and one of said sides, said relieved portion configured to operatively receive a mounting arm therein and defines a substantially planar mounting wall perpendicular to said bottom, said mounting wall including a circular aperture into which a complimentarily sized boss on said mounting arm is rotationally journaled;

means for releasably locking said mounting arm to said mounting wall at selected angular positions of said mounting arm relative to said housing;

a cover including a transparent portion pivotably mounted to said housing in said open front;

hinge means associated with said cover and said housing providing for said pivotal mounting of said cover;

electrical component means mounted in said housing adapted to connect to an external power source for energizing a lamp; and light reflector means mounted in said housing for reflecting light from said lamp through said transparent portion.

13. The light fixture as defined in claim 12, wherein said mounting arm is a hollow member, and said boss protrudes from one side thereof, said member being open at a side opposite said one side, said arm includes means for mounting to an external mounting member and an access opening into said hollow interior for accommodating passage of electrical leads from said electrical components, and a cover plate removably mounted over said open side.

14. The light fixture as defined in claim 13, further comprising:

a photo-electric cell mounted in said hollow mounting arm electrically coupled to said electrical component means.

15. The light fixture as defined in claim 14, wherein said mounting arm hollow member is a one-piece die cast member.

16. The light fixture as defined in claim 13, wherein said hinge comprises:

at least one hinge pin attached to an edge of said cover in parallel spaced apart relationship with said edge;

at least one flange on said housing adjacent the open front thereof, including means for receiving said hinge pin, said means for receiving adapted to provide support for said cover, pivotal movement of said hinge pin; and means for retaining said hinge pin to said means for receiving said cover.

17. The lighting fixture as defined in claim 16, wherein said means for retaining said hinge pin to said means for receiving comprises:

a clip having a first generally planar portion removably attached to said flange, a second intermediate portion extending from said first portion at substantially a right angle thereto, and a third portion extending from said intermediate portion over said hinge pin into the space between said hinge pin and said edge of said cover.

18. The light fixture as defined in claim 17, wherein said clip is a curvilinear shaped member having a portion adjacent an end thereof partially folded back over itself defining a hook-shaped configuration sized to at least partially encircle said hinge pin.

19. A light fixture comprising:

a one piece housing including a bottom, a top, two opposing sides joined together in end-to-end relationship, and a back defining an interior, said housing having an open front and a relieved portion at a lowermost corner defining an upstanding mounting wall intermediate said opposing sides projecting into said interior of said housing perpendicularly from said bottom, said mounting wall including a circular clearance hole into said interior;

a pair of spaced apart upstanding members cast into said housing adjacent said mounting wall at diametrical opposite positions relative to said clearance hole, said upstanding members including opposing aligned slots lying in a common plane parallel to said support wall;

a mounting arm having a hollow interior and including means for mounting said arm to an external mounting member and including a circular boss on one side rotatably journaled in said clearance hole, said mounting arm having an aperture coaxially through said boss defining an axis of rotation of said mounting arm and having at least one opening connecting said hollow interior of said mounting arm with the interior of said housing;

a plate slidably received in said aligned slots in said upstanding members spanning the space therebetween and including a threaded hole coaxially aligned with said aperture in said boss;

an elongated threaded fastener extending through said aperture in said boss threadedly engaged in said threaded hole;

electrical component means within said housing for energizing a lamp;

light reflector means within said housing for reflecting light from said lamp; and a cover pivotally mounted to said housing including a light transparent portion adjacent said reflector means.

20. The light fixture, as defined in claim 19, further comprising:

a photo-electric cell mounted within said hollow mounting arm electrically coupled to said electrical component means.

21. The light fixture as defined in claim 20, wherein said mounting arm is open at a side thereof opposite said one side and a cover plate is removably attached to said mounting arm over said open side, said cover plate including a hole and said photo-cell is mounted in said hole.

22. The lighting fixture as defined in claim 19, wherein said mounting arm includes a substantially cylindrical portion and a substantially rectilinear portion extending from said cylindrical portion, said circular boss located coaxial with said cylindrical portion, and said means for mounting said mounting arm is located at a free end of said rectilinear portion.

* * * * *